US011623670B2

(12) United States Patent
Wu et al.

(10) Patent No.: US 11,623,670 B2
(45) Date of Patent: Apr. 11, 2023

(54) TRAIN CONTROL METHOD, APPARATUS, AND SYSTEM

(71) Applicant: BYD COMPANY LIMITED, Shenzhen (CN)

(72) Inventors: Dandan Wu, Shenzhen (CN); Faping Wang, Shenzhen (CN); Zhili Wu, Shenzhen (CN); Yunlan Bao, Shenzhen (CN); Kaikuo Zhuo, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 376 days.

(21) Appl. No.: 16/959,885

(22) PCT Filed: Dec. 25, 2018

(86) PCT No.: PCT/CN2018/123456

§ 371 (c)(1),
(2) Date: Jul. 2, 2020

(87) PCT Pub. No.: WO2019/134558

PCT Pub. Date: Jul. 11, 2019

(65) Prior Publication Data

US 2020/0331506 A1 Oct. 22, 2020

(30) Foreign Application Priority Data

Jan. 8, 2018 (CN) ..... 201810015698.2

(51) Int. Cl.
*B61L 27/00* (2022.01)
*B61L 3/00* (2006.01)
*B61L 25/02* (2006.01)

(52) U.S. Cl.
CPC ..... *B61L 3/006* (2013.01); *B61L 25/023* (2013.01); *B61L 25/028* (2013.01)

(58) Field of Classification Search
CPC ..... B61L 3/006; B61L 25/023; B61L 25/028
See application file for complete search history.

(56) References Cited

U.S. PATENT DOCUMENTS

2013/0325247 A1* 12/2013 Kanner ..... B61L 25/028 701/29.3
2017/0210401 A1 7/2017 Mian
2018/0312182 A1* 11/2018 Prestail ..... B61L 15/0063

FOREIGN PATENT DOCUMENTS

CN 103738368 A 4/2014
CN 104354726 A 2/2015
(Continued)

OTHER PUBLICATIONS

The World Intellectual Property Organization (WIPO) International Search Report for PCT/CN2018/123456 dated Mar. 4, 2019 7 Pages.

(Continued)

*Primary Examiner* — Adam D Tissot
(74) *Attorney, Agent, or Firm* — Anova Law Group, PLLC

(57) ABSTRACT

A train control method is provided for a vehicle on-board controller (VOBC) configured on one end of a train. The method includes: performing a train awakening process; acquiring a running plan sent by an automatic train supervision (ATS) system after the train is successfully awakened; setting, according to a direction indicated by the running plan, a running direction of the train to be downward or upward; when the running direction is set to downward, using, as a head for train positioning, one end of the train not configured with the VOBC, to acquire positioning information of the train; when the running direction is set to upward, using, as the head for train positioning, one end of the train configured with the VOBC, to acquire the positioning information of the train; and controlling, according to the posi- (Continued)

tioning information of the train, the train to pull out of a parking garage.

14 Claims, 3 Drawing Sheets

(56) References Cited

FOREIGN PATENT DOCUMENTS

| | | | | | |
|---|---|---|---|---|---|
| CN | 104442928 | A | | 3/2015 | |
| CN | 104494649 | A | | 4/2015 | |
| CN | 106394617 | A | | 2/2017 | |
| CN | 106444744 | A | | 2/2017 | |
| CN | 106515797 | A | | 3/2017 | |
| CN | 106541965 | A | | 3/2017 | |
| CN | 106672019 | A | | 5/2017 | |
| CN | 106672031 | A | | 5/2017 | |
| CN | 107226099 | A | | 10/2017 | |
| FR | 3065699 | A1 | * | 11/2018 | ..... B61L 15/0027 |
| FR | 3065699 | A1 | | 11/2018 | |

OTHER PUBLICATIONS

Songtao Wang, "Introduce of VOBC and Analysis of Breakdown for loss of WSP", China Academic Journal Electronic Publishing House, Jun. 3, 2010, Shanghai, p. 430-434.

* cited by examiner

TRAIN CONTROL METHOD, APPARATUS, AND SYSTEM

CROSS-REFERENCE TO RELATED APPLICATIONS

The present application is a national phase entry under 35 U.S.C. § 371 of International Application No. PCT/CN2018/123456, filed on Dec. 25, 2018, which claims priority to Chinese Patent Application No 201810015698.2, filed by the BYD Co., Ltd. on Jan. 8, 2018 and entitled "TRAIN CONTROL METHOD, APPARATUS, AND SYSTEM", content of all of which is incorporated herein by reference in entirety.

FIELD

The present disclosure relates to the technical field of track traffic and, in particular, to a train control method, apparatus, and system.

BACKGROUND

In the related art, a vehicle on-board controller (VOBC) is respectively disposed in a head and a tail of a full-automatic driverless train. During remote awakening, one of the head and tail ends first performs an awakening process in a default order, and then automatically switches to the other end, and the other end performs the awakening process. The train can be successfully awakened after both ends are successfully awakened. Furthermore, under the supervision of an automatic train supervision (ATS) system, the train pulls out of a garage.

In the process of awakening the train, the train can be successfully awakened only if the VOBCs at both ends of the head and tail are successfully awakened. If a VOBC at one end has an error during the awakening, the train fails to be awakened, resulting in a relatively low rate of successfully awakening the train. In addition, since the VOBCs at both ends need to be awakened in turn, it needs a relatively long time for awakening the train. Further, after the train is awakened, when a running direction indicated by the ATS does not match an initially activated cab at one end of the train, the other end of the train is further needed to activate a cab to be capable of pulling out of the garage normally, which is complicated to operate and leads to low running efficiency of the train.

SUMMARY

The present disclosure is intended to resolve at least one of the technical problems in the related art to some extent.

To this perspective, a first objective of the present disclosure is to propose a train control method. A vehicle on-board controller (VOBC) is disposed at a single end of a train to simplify configuration of the train, reduce costs of the train, and shorten duration required for awakening the train, thereby improving the efficiency of awakening the train. Further, in different running directions, the end of the train does not need to be changed to activate a cab, simplifying the operation steps and improving the running efficiency of the train.

A second objective of the present disclosure is to propose a train control apparatus.

A third objective of the present disclosure is to propose a train control system.

A fourth objective of the present disclosure is to propose a computer device.

In order to achieve the foregoing objectives, an embodiment of a first aspect of the present disclosure proposes a train control method, one end of the train being configured with a vehicle on-board controller (VOBC). The train control method includes:

performing, by the VOBC, a train awakening process;

acquiring, by the VOBC, a running plan sent by an automatic train supervision (ATS) system after a train is successfully awakened;

setting, by the VOBC according to a direction indicated by the running plan, a running direction of the train to be downward or upward;

when the running direction is set to be downward, using, by the VOBC, as a head for train positioning, the other end of the train not configured with the VOBC, to acquire positioning information of the train; and when the running direction is set to be upward, using, by the VOBC, as the head for train positioning, one end of the train configured with the VOBC, to acquire the positioning information of the train; and controlling, according to the positioning information of the train, the train to pull out of a parking garage.

According to the train control method of the present disclosure, the VOBC is configured at only one end of the train, thereby simplifying the train configuration and reducing train costs. In addition, it only awakens the VOBC at one end of the train, which shortens duration required for awakening the train and improves the efficiency of awakening the train. Moreover, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

In order to achieve the foregoing objectives, an embodiment of a second aspect of the present disclosure proposes a train control apparatus applied to a vehicle on-board controller (VOBC). The apparatus includes:

an awakening module configured to perform a train awakening process;

an acquiring module configured to acquire a running plan sent by an automatic train supervision (ATS) system after a train is successfully awakened;

a setting module configured to set, according to a direction indicated by the running plan, a running direction of the train to be downward or upward; and a control module configured to: when the running direction is set to be downward, use, as a head of the train for train positioning, the other end of the train not configured with the VOBC, to acquire positioning information of the train; when the running direction is set to be upward, use, as the head of the train for train positioning, one end of the train configured with the VOBC, to acquire the positioning information of the train; and control, according to the positioning information of the train, the train to pull out of a parking garage.

According to the train control apparatus of the present disclosure, the VOBC is configured at only one end of the train, thereby simplifying the train configuration and reducing train costs. In addition, it only awakens the VOBC at one end of the train, which shortens duration required for awakening the train and improves the efficiency of awakening the train. Moreover, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

In order to achieve the foregoing objectives, an embodiment of a third aspect of the present disclosure proposes a train control system, including: a vehicle on-board controller (VOBC) and an automatic train supervision (ATS) system communicating with each other, the VOBC being configured to perform the train control method according to the embodiment of the first aspect of the present disclosure; and the ATS system being configured to send a running plan to the VOBC after the VOBC is successfully awakened.

According to the train control system of the present disclosure, the VOBC is configured at only one end of the train, thereby simplifying the train configuration and reducing train costs. In addition, it only awakens the VOBC at one end of the train, which shortens duration required for awakening the train and improves the efficiency of awakening the train. Moreover, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

In order to achieve the foregoing objectives, an embodiment of a fourth aspect of the present disclosure proposes a computer device, including: a memory, a processor, and a computer program stored on the memory and executable on the processor, when the processor executes the program, the train control method according to the embodiment of the first aspect of the present disclosure being implemented.

Other aspects and advantages of the present disclosure will be given in the following description, some of which will become apparent from the following description or may be learned from practices of the present disclosure.

BRIEF DESCRIPTION OF THE DRAWINGS

The foregoing and/or additional aspects and advantages of the present disclosure will become apparent and comprehensible in the description made with reference to the following accompanying drawings, where.

DETAILED DESCRIPTION

Figure 1:
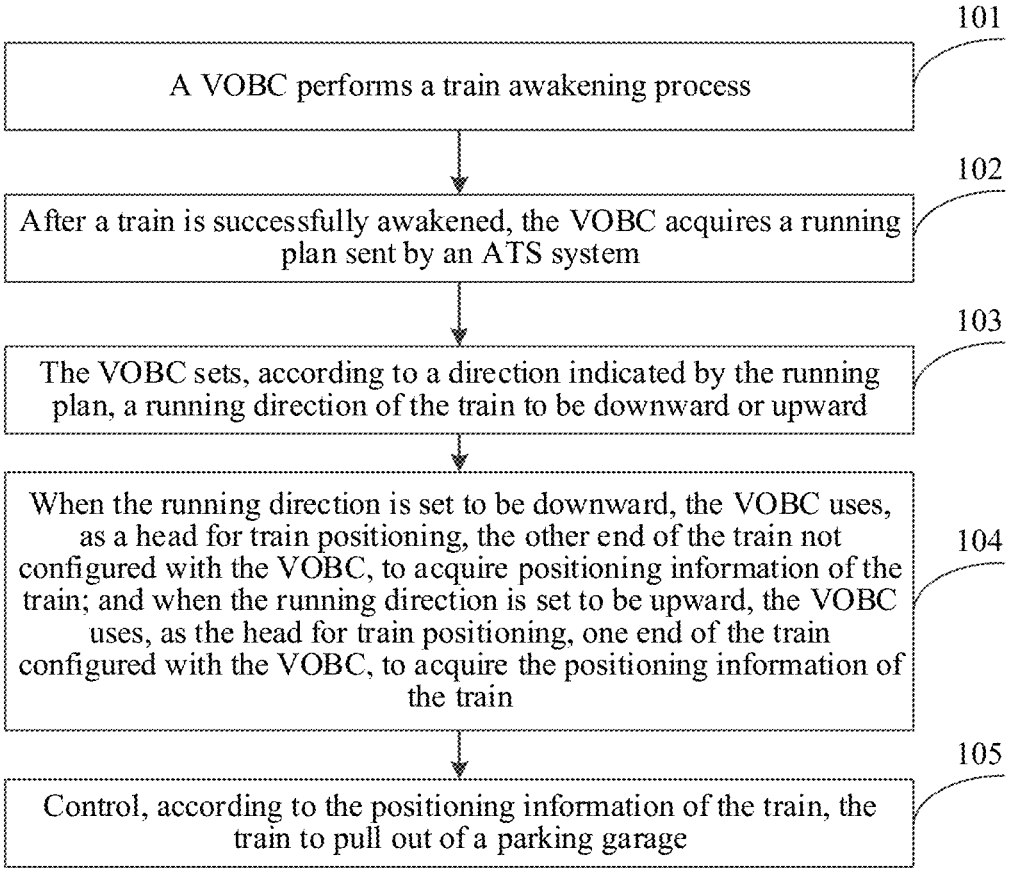
FIG. 1 is a schematic flowchart of a train control method according to one embodiment of the present disclosure.

The following describes embodiments of the present disclosure in detail. Examples of the embodiments are shown in the accompanying drawings, and same or similar reference signs in the accompanying drawings may indicate same or similar components or components having same or similar functions. The embodiments described below with reference to the accompanying drawings are exemplary, and are intended to explain the present disclosure and cannot be construed as a limitation to the present disclosure.

In the related art, a VOBC is respectively disposed in a head and a tail of a full-automatic driverless train, that is, each VOBC comprises system A and system B which are configured redundantly. During remote awakening, one of the head and tail ends first performs an awakening process in a default order, and then automatically switches to the other end, and the other end performs the awakening process. The train can be successfully awakened after both ends are successfully awakened. When the train is successfully awakened, a running direction may be applied from an automatic train supervision (ATS) system, and then the train may activate a cab at one end of the train according to the running direction sent by the ATS system. If an activation end indicated by the running direction is inconsistent with the current activation end, the activation end will automatically switch to the other end to activate the cab at the other end. If the two are consistent, the end does not need to be changed. The train may then apply to a zone controller (ZC) for movement authorization, and control, according to information about the movement authorization of the ZC, the train to pull out of a garage.

When the train is running, only one VOBC needs to be activated, and the other VOBC is not in an activated state, causing a waste of resources and an increase in train costs. In addition, in the awakening process of the train, the train can be successfully awakened only if the VOBCs at both ends of the head and tail are successfully awakened. If a VOBC at one end has an error during the awakening, the train fails to be awakened, resulting in a relatively low rate of successfully awakening the train. In addition, since the VOBCs at both ends need to be awakened in turn, it needs a relatively long time for awakening the train. Further, in different running directions, the ends of the train need to be switched to activate a cab to be capable of pulling out of the garage normally, which is complicated to operate and leads to low running efficiency of the train.

In the related art, due to a long time, high costs, and low availability for awakening the train, and when the running direction is different, the ends of the train need to be switched to activate the cab to be capable of pulling out of the garage normally, in the embodiments of the present disclosure, the VOBC is configured at only one end of the train, simplifying the train configuration and reducing the train costs. In addition, it is only necessary to awaken the VOBC at one end of the train, which shortens duration required for awakening the train and improves the efficiency of awakening the train. Moreover, in the embodiments of the present disclosure, when the running direction is set to be downward, the VOBC uses, as the head for train positioning, the other end of the train not configured with the VOBC. When the running direction is set to be upward, the VOBC uses, as the head for train positioning, one end of the train configured with the VOBC. The train is controlled, according to positioning information of the train, to pull out of the parking garage. Therefore, in different running directions, the end of the train does not need to be changed to activate a cab, simplifying the operation steps and improving the running efficiency of the train.

The train control method, apparatus, and system of the embodiments of the present disclosure are described below with reference to the accompanying drawings. Before the embodiments of the present disclosure are described in detail, in order to facilitate understanding, common technical words are first introduced below:

Vehicle On Board Controller, VOBC

Zone Controller, ZC

Cyclic Redundancy Check, CRC

FIG. 1 is a schematic flowchart of a train control method according to one embodiment of the present disclosure.

This embodiment of the present disclosure is performed by a vehicle on-board controller (VOBC), and an awakening process and a pulling out process.

The VOBC may include an auto train protection (ATP for short) system and an automatic train operation (ATO for short) system.

As shown in FIG. 1, the train control method includes the following steps.

Step 101: The VOBC performs a train awakening process.

In one embodiment of the present disclosure, the VOBC is configured at only one end of a train, thereby simplifying the train configuration and reducing train costs. In addition, it only awakens the VOBC at one end of the train, which shortens duration required for awakening and improves the awakening efficiency.

In one embodiment of the present disclosure, after the VOBC is powered on, the self-check process may be started, and the self-check status of the train is received. If the train is powered on and the self-check is successful, and the VOBC is also powered on and the self-check is successful, the VOBC may perform a subsequent train awakening process.

Specifically, the power-on awakening module may send an awakening instruction to the VOBC. When the VOBC receives the awakening instruction, it is determined that the state of the VOBC is changed from a dormant state to an awakening start state, and the power-on awakening module is notified that the self-check of the VOBC is successful. Then, the VOBC may perform static and dynamic tests. When the static and dynamic tests are completed, the train is successfully awakened. The static test means that after the power-on self-check on the train and the VOBC are completed, the VOBC initiates and cooperates with the train to perform a functional test such as network communication, wireless communication, broadcasting, traction enabling, braking, lighting, an electric whistle, a door, and the like of the VOBC and the vehicle. The dynamic test means applying to a ground device for dynamic test authorization to control the train to move forward and backward by a short distance and brake for parking.

Step 102: The VOBC acquires a running plan sent by an automatic train supervision (ATS) system after the train is successfully awakened.

In one embodiment of the present disclosure, after being successfully awakened, the train may wait for the departure. Specifically, the VOBC may receive the running plan sent by the ATS system to trigger, according to the running plan, the step of subsequently performing the pulling out process.

Step 103: The VOBC sets, according to a direction indicated by the running plan, a running direction of the train to be downward or upward.

In one embodiment of the present disclosure, after receiving the running plan, the VOBC may set, according to the direction indicated by the running plan, the running direction of the train to be downward or upward. Running downward indicates running toward the other end not configured with the VOBC, and running upward indicates running toward one end configured with the VOBC.

Figure 2:
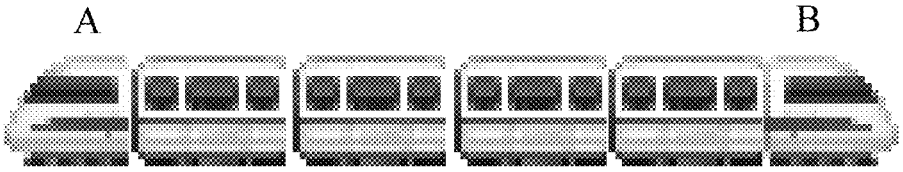
FIG. 2 is a schematic diagram of a disposing position of a vehicle on-board controller (VOBC) according to an embodiment of the present disclosure.

For example, referring to FIG. 2, FIG. 2 is a schematic diagram of a disposing position of a vehicle on-board controller (VOBC) according to an embodiment of the present disclosure. The VOBC is disposed in a carriage A of the train, and a carriage B of the train is not provided with the VOBC. If the direction indicated by the running plan is $\overrightarrow{AB}$, the VOBC may set the running direction of the train to be downward. If the direction indicated by the running plan is $\overrightarrow{BA}$, the VOBC may set the running direction of the train to be upward.

Step 104: When the running direction is set to be downward, the VOBC uses, as a head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train.

In one embodiment of the present disclosure, the VOBC may position the train according to the head of the train. It should be noted that in different running directions, heads are different. Specifically, when the running direction is set to be upward, one end of the train configured with the VOBC is used as the head, and the other end not configured with the VOBC is used as the tail. The VOBC may directly position the train according to the head, that is, position the train according to the end of the train configured with the VOBC. For example, referring to FIG. 2, when the VOBC is disposed in the carriage A of the train, when the running direction is set to be upward, the carriage A is used as the head and the carriage B is used as the tail. In this case, the VOBC may position the train according to the carriage A.

When the running direction is set to be downward, the other end of the train not configured with the VOBC is used as the head, and one end configured with the VOBC is used as the tail. The VOBC may position the train according to the head, that is, position the train according to the other end of the train not configured with the VOBC. The foregoing example is still used as an example. When the running direction is set to be upward, the carriage B is used as the head and the carriage A is used as the tail. The VOBC may position the train according to the carriage B.

In a possible implementation, the positioning a train to acquire positioning information of the train includes: when the running direction is set to be upward, directly determining a position of the head of the train according to a distance between the one end of the train configured with the VOBC and a ground transponder; and when the running direction is set to be downward, subtracting a length of the train from the distance between the end of the train configured with the VOBC and the ground transponder, to obtain a distance between the other end of the train not configured with the VOBC and the ground transponder; and then determining a position of the head of the train according to the distance between the other end of the train not configured with the VOBC and the ground transponder. In one embodiment, the train positioning can be completed by setting a transponder on the ground, thereby simplifying the process of positioning the train.

Step 105: Control, according to the positioning information of the train, the train to pull out of a parking garage.

In one embodiment of the present disclosure, the train may be controlled to pull out of the parking garage according to a direction in which the train actually travels. Specifically, during upward pulling out of the parking garage, the VOBC determines whether the train needs to travel in a direction of one end configured with the VOBC. If yes, the VOBC controls the train to move forward in the upward direction, and if not, the VOBC controls the train to move backward in the upward direction.

During downward pulling of the parking garage, the VOBC determines whether the train needs to travel in a direction of the other end not configured with the VOBC. If yes, the VOBC controls the train to move forward in the downward direction, and if not, the VOBC controls the train to move backward in the downward direction.

Specifically, when the VOBC determines whether the train needs to travel in the direction of the end configured with the VOBC, which may be determined according to the running direction of the train and the positioning information of the train. For example, the train runs in an upward direction. If the positioning information of the train indicates that the position of the head of the train is the end configured with the VOBC, it is determined that the train needs to travel toward the end configured with the VOBC. If the positioning information of the train indicates that the position of the head of the train is the other end not configured with the VOBC, it is determined that the train does not need to travel toward the end configured with the VOBC.

Further, after determining an actual driving direction of the train, the VOBC may control, the train to pull out of the parking garage according to movement authorization information sent by a zone controller ZC.

According to the train control method of one embodiment, the VOBC is configured at only one end of the train, thereby simplifying the train configuration and reducing train costs. In addition, it only awakens the VOBC at one end of the train, which shortens duration required for awakening the train and improves the efficiency of awakening the train. Moreover, in one embodiment, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

Figure 3:
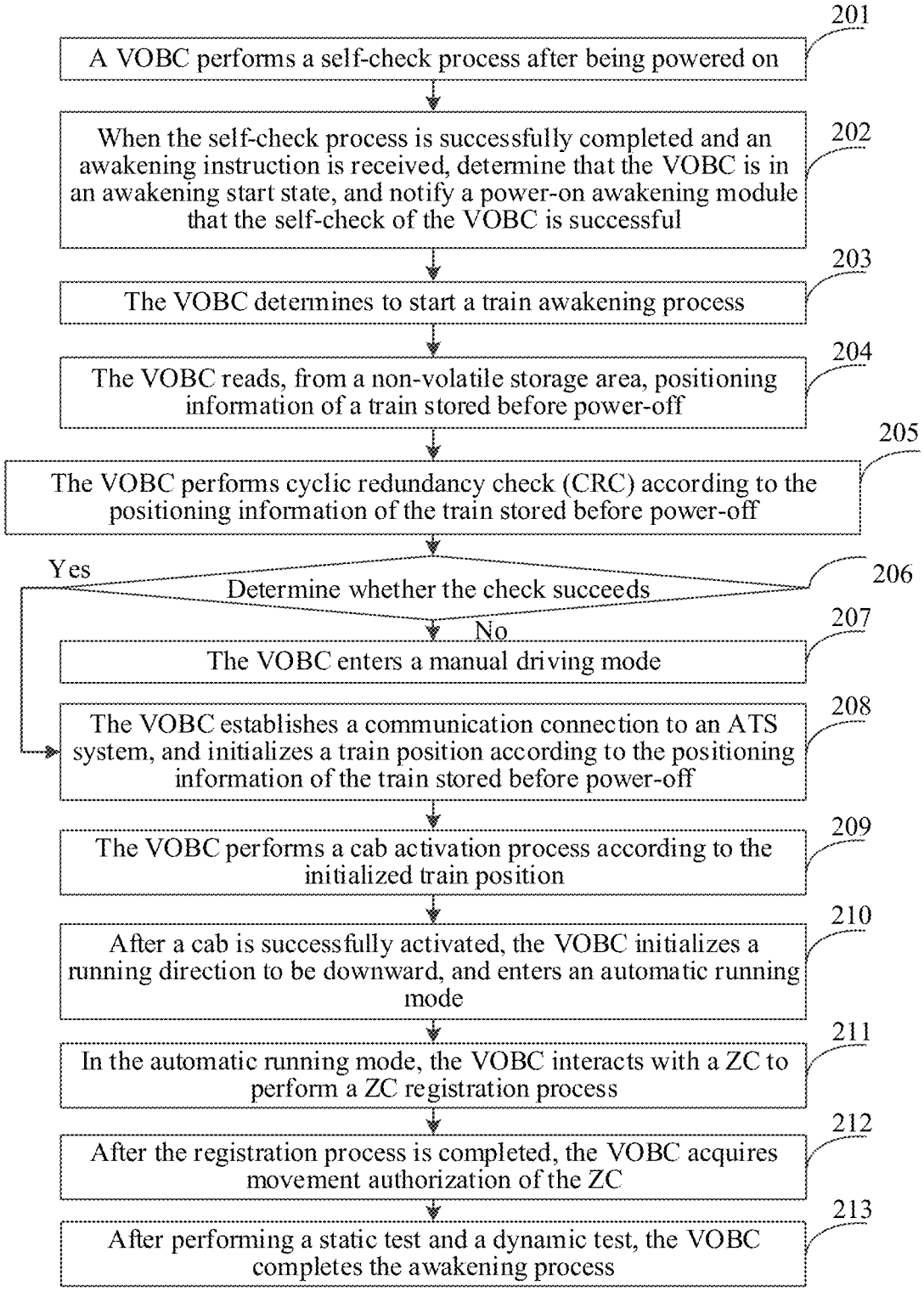
FIG. 3 is a schematic flowchart of a train control method according to another embodiment of the present disclosure.

In a possible implementation, referring to FIG. 3, on the basis of the embodiment shown in FIG. 1, step 101 specifically includes the following sub-steps.

Step 201: After the VOBC is powered on, the VOBC performs a self-check process.

In one embodiment of the present disclosure, after the VOBC is powered on, the VOBC may perform the self-check process, and receive a self-check status of the train. When the self-check process on the train and the VOBC is successfully completed, step 202 may be performed.

Step 202: When the self-check process is successfully completed and an awakening instruction is received, determine that the VOBC is in an awakening start state, and notify a power-on awakening module that the self-check of the VOBC is successful.

In one embodiment of the present disclosure, when the self-check process on the VOBC is successfully completed and the awakening instruction sent by the power-on awakening module is received, it is determined that a state of the VOBC is changed from the dormant state to the awakening start state, and the power-on awakening module is notified that the self-check on the VOBC is successful.

Step 203: The VOBC determines that a train awakening process is started.

In one embodiment of the present disclosure, when the self-check on the VOBC is successful, the train awakening process may be performed.

Step 204: The VOBC reads, from a non-volatile storage area, positioning information of the train stored before power-off.

In one embodiment of the present disclosure, the non-volatile storage area may be used to store the position information of the train when dormant, so that data loss during power-off can be effectively avoided. After the train is powered on, the positioning information of the train stored before power-off may be read from the non-volatile storage area.

Step 205: The VOBC performs cyclic redundancy check (CRC) according to the positioning information of the train stored before power-off.

Optionally, in order to verify the validity and accuracy of the positioning information that is of the train stored before the power-off and that is read from the non-volatile storage area, in one embodiment of the present disclosure, the VOBC may perform the CRC on the positioning information of the train stored before power-off.

Step 206: Determine whether the check is successful, if yes, perform step 208, and otherwise, perform step 207.

Optionally, when the CRC is successful, it indicates that the read positioning information of the train stored before the power-off is valid, and in this case, step 208 may be triggered. When the CRC fails, it indicates that the read positioning information of the train stored before the power-off is invalid, and in this case, step 207 may be triggered.

Step 207: The VOBC enters a manual driving mode.

In one embodiment of the present disclosure, when the CRC fails, in order to enable the train to depart normally and successfully pull out of the parking garage, the VOBC may enter the manual driving mode from the automatic driving mode.

Step 208: The VOBC establishes a communication connection with the ATS system, and initializes a train position according to the positioning information of the train stored before power-off.

In one embodiment of the present disclosure, after the CRC is successful, the VOBC may establish a communication connection with the ATS system, so that the VOBC may exchange data with the ATS system. In addition, the VOBC may initialize the train position according to the positioning information of the train stored before the power-off, and restore the current position of the train to the position of the train before the power-off.

Step 209: The VOBC performs a cab activation process according to the initialized position of the train.

In one embodiment of the present disclosure, when the train is in the manual driving mode, the cab may be started manually by using a key. However, when the train is in the automatic driving mode, the cab activation process may be automatically performed through the VOBC.

Specifically, when successfully initializing the position of the train, the VOBC may perform the cab activation process according to the initialized position of the train. Specifically, the VOBC may determine whether the train position is located within a preset parking area of the parking garage. When determining that the initialized train position is within the preset parking area of the parking garage, the VOBC may output an equivalent key signal to a device in the cab, the equivalent key signal being used to activate the cab. When the VOBC determines that initialized train position is not within the preset parking area of the parking garage, the VOBC may enter a standby mode to wait for manual troubleshooting, and/or send prompt information for fault positioning to the ATS system, so that a user may learn a positioning fault through the prompt information displayed on the interface, and arrange relevant personnel to eliminate the fault.

The standby mode is a working mode in which the cab is not activated upon completion of the self-check and initialization by the VOBC. In the standby mode, only a braking signal is output to ensure that the train does not move, and other control functions are not available.

Further, after the VOBC fails to initialize the position of the train, the VOBC may also enter the standby mode to wait for manual troubleshooting, and/or send the prompt information for fault positioning to the ATS system.

Step 210: After the cab is successfully activated, the VOBC initializes the running direction to be downward, and enters an automatic running mode.

Under normal circumstances, the train enters the parking garage upward, and accordingly, the train may pull out of the parking garage downward. Therefore, in one embodiment of the present disclosure, after the cab is successfully activated, the VOBC may initialize the running direction to be downward, and enter the automatic running mode.

Step 211: In the automatic running mode, the VOBC interacts with the ZC to perform a ZC registration process.

Specifically, the VOBC may send a registration request to the ZC, and then wait for a registration confirmation reply of the ZC.

Step 212: The VOBC acquires movement authorization of the ZC after the registration process is completed.

Optionally, when the VOBC receives the registration confirmation reply of the ZC, it indicates that the VOBC and the ZC are successfully registered. In this case, the registration process is completed. Then, the VOBC may acquire the movement authorization of the ZC. Specifically, the VOBC may send, to the ZC, the positioning information of the train stored before the power-off, and the ZC may determine, according to the positioning information of the train, whether the train is a train awakened after dormancy. When the ZC determines that the train is the train awakened after dormancy, the head and tail of the train may be adjusted according to the running direction reported by the VOBC, and the movement authorization that allows running is sent to the VOBC. Specifically, the ZC adjusts position information of the head and tail of the train according to the running direction reported by the VOBC, and is used to send movement authorization to the train to allow the train to run toward the position of the head.

Step 213: The VOBC completes the awakening process upon completion of a static test and a dynamic test.

Optionally, after acquiring the movement authorization of the ZC, the VOBC may perform static and dynamic tests. After the static and dynamic tests are performed, the VOBC completes the train awakening process.

According to the train control method of one embodiment, the VOBC is configured at only one end of the train, thereby simplifying the train configuration and reducing train costs. In addition, it only awakens the VOBC at one end of the train, which shortens duration required for awakening and improves the awakening efficiency. Moreover, in one embodiment, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

In order to implement the foregoing embodiments, the present disclosure further provides a train control system.

Figure 4:
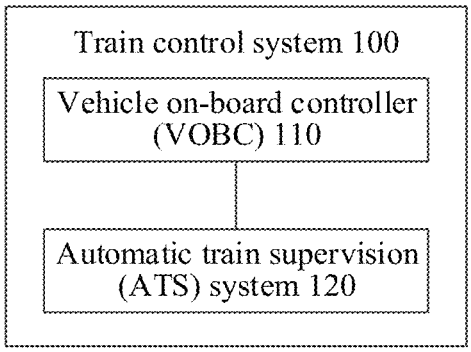
FIG. 4 is a schematic structural diagram of a train control system according to another embodiment of the present disclosure.

FIG. 4 is a schematic structural diagram of a train control system according to one embodiment of the present disclosure.

As shown in FIG. 4, a train control system 100 includes: a vehicle on-board controller (VOBC) 110 and an automatic train supervision (ATS) system 120 communicating with each other.

The VOBC 110 is configured to perform the train control method for performing the embodiments in FIG. 1 to FIG. 3.

The ATS system 120 is configured to send a running plan to the VOBC 110 after the VOBC 110 is successfully awakened. Correspondingly, after receiving the running plan, the VOBC 110 may control, according to the running plan, the train to pull out of the parking garage.

According to the train control system in one embodiment, the VOBC is configured at only one end of the train, thereby simplifying the train configuration and reducing train costs. In addition, it only awakens the VOBC at one end of the train, which shortens duration required for awakening the train and improves the efficiency of awakening the train. Moreover, in one embodiment, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

In a possible implementation, before the train is awakened and leaves the garage, power may further be supplied to the train. The foregoing process is described in detail below with reference to FIG. 5.

Figure 5:
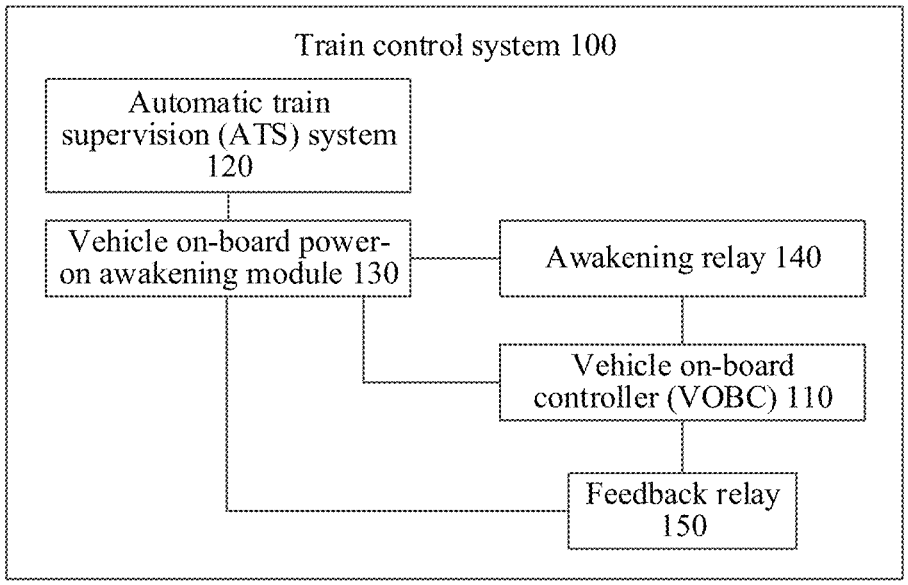
FIG. 5 is a schematic structural diagram of a train control system according to another embodiment of the present disclosure.

FIG. 5 is a schematic structural diagram of a train control system according to Embodiment IV of the present disclosure.

As shown in FIG. 5, on the basis of the embodiment shown in FIG. 4, the train control system 100 may further include: a vehicle on-board power-on awakening module 130, an awakening relay 140, and a feedback relay 150.

The vehicle on-board power-on awakening module 130 communicates with the ATS system 120.

The ATS system 120 is further configured to: acquire a power-on awakening command for power-on awakening of each system of the train, each system of the train including a vehicle on-board controller (VOBC) 110; send the power-on awakening command to the vehicle on-board power-on awakening module 130; receive the power-on awakening command returned by the vehicle on-board power-on awakening module 130, and display, on an interface, the power-on awakening command returned by the vehicle on-board power-on awakening module 130; and send the power-on awakening command to the vehicle on-board power-on awakening module 130 again when a user confirmation instruction is detected.

The vehicle on-board power-on awakening module 130 is configured to: return the power-on awakening command to the ATS system 120 after receiving the power-on awakening command sent by the ATS system 120; again receive the power-on awakening command sent by the ATS system 120; and supply, when it is determined that the two received power-on awakening commands are the same, power to a train indicated by the power-on awakening command.

Specifically, the power-on awakening command for power-on awakening on each system of the specified train may be generated according to an operation of scheduling a workstation interface by a user, and then the ATS system 120 may acquire the power-on awakening command, where the power-on awakening command may carry related information of the specified train. After the ATS system 120 receives the power-on awakening command, the power-on awakening command may be sent to the vehicle on-board power-on awakening module 130. Accordingly, the vehicle on-board power-on awakening module 130 may receive the power-on awakening command. When receiving the power-on awakening command, the vehicle on-board power-on awakening module 130 may return the power-on awakening command to the ATS system 120. It should be noted that, under normal circumstances, the power-on awakening command received by the vehicle on-board power-on awakening module 130 should be the same as the power-on awakening command returned to the ATS system 120.

Accordingly, after receiving the power-on awakening command returned by the vehicle on-board power-on awakening module 130, the ATS system 120 may display, on the interface, the power-on awakening command returned by the vehicle on-board power-on awakening module 130, so that the user may confirm the power-on awakening command returned by the vehicle on-board power-on awakening module 130, to avoid mis-operation or an error caused in the information transmission process.

When detecting the user confirmation instruction, the ATS system 120 may again receive the power-on awakening command to the vehicle on-board power-on awakening module 130. Accordingly, the vehicle on-board power-on awakening module 130 may again receive the power-on awakening command sent by the ATS system 120, and supply, when it is determined that the two received power-on awakening commands are the same, power to a train indicated by the power-on awakening command.

In one embodiment of the present disclosure, the vehicle on-board power-on awakening module 130 receives the power-on awakening command twice and confirms the power-on awakening command, which can ensure that the train indicated by the power-on awakening command can be correctly awakened in a fully automatic driverless scenario, thereby increasing a rate of successfully awakening the specified train.

In one embodiment of the present disclosure, the train control system 100 may further include: an awakening relay 140.

The vehicle on-board power-on awakening module 130 is specifically configured to: after it is determined that the two received power-on awakening commands are the same, control the awakening relay 140 to continue supplying power to the train, and send, to the ATS system 120, a status indication message for indicating that power-on awakening is being performed, so that the ATS system 120 displays the status indication message.

The awakening relay 140 is configured to close a contact under the control of the vehicle on-board power-on awakening module 130, to continue supplying power to the train.

Specifically, when the vehicle on-board power-on awakening module 130 determines that the two received power-on awakening commands are the same, the awakening relay 140 may be driven, by using a hard wire, to close a contact, and after the contact of the awakening relay 140 is closed, the power supply to the train may be continued, so that each system of the train including the VOBC 110 may be powered on and started. Further, the vehicle on-board power-on awakening module 130 may further send, to the ATS system 120, the status indication message for indicating that power-on awakening is being performed. After the ATS system 120 receives the status indication message, the status indication message may be displayed on the interface, so that the user may learn the state of the train in real time through the interface.

In one embodiment of the present disclosure, the train control system 100 may further include: a feedback relay 150.

The feedback relay 150 is configured to close a contact after the VOBC 110 of the train is powered on.

Optionally, when the vehicle on-board power-on awakening module 130 further communicates with the VOBC 110, the vehicle on-board power-on awakening module 130 may continue to send an awakening instruction to the VOBC 110 when detecting that the contact of the feedback relay 150 is closed, where the awakening instruction is used to control the VOBC 110 to perform the awakening process.

In one embodiment of the present disclosure, the vehicle on-board power-on awakening module 130 continuously sends the awakening instruction to the VOBC 110, which can increase the rate of successfully awakening the VOBC.

In addition, after detecting that the contact of the feedback relay 150 is closed, the vehicle on-board power-on awakening module 130 may further send, to the ATS system 120, a status indication message for indicating that power-on awakening is being performed. When it is not detected that the contact of the feedback relay 140 is closed within preset duration, the vehicle on-board power-on awakening module 130 may send, to the ATS system 120, a status indication message for indicating a power-on awakening failure, so that the user can learn, through the status indication message displayed on the interface, that the power-on awakening fails. Further, the user may re-trigger the power-on awakening command to perform power-on awakening on the systems of the train again, thereby further increasing the rate of successfully awakening the systems of the train.

In order to implement the foregoing embodiment, the present disclosure further provides a train control apparatus.

Figure 6:
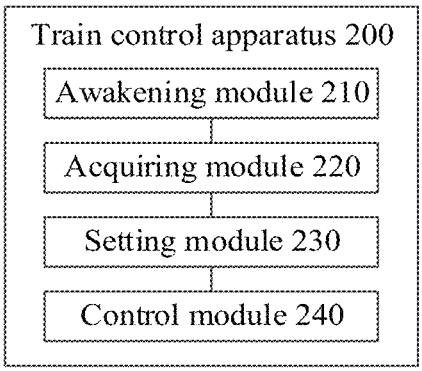
FIG. 6 is a schematic structural diagram of a train control apparatus according to another embodiment of the present disclosure.

FIG. 6 is a schematic structural diagram of a train control apparatus according to one embodiment of the present disclosure.

As shown in FIG. 6, a train control apparatus 200 applied to the VOBC proposed in the foregoing embodiments of FIG. 4 to FIG. 5, including: an awakening module 210, an acquiring module 220, a setting module 230, and a control module 240.

The awakening module 210 is configured to perform a train awakening process.

In a possible implementation, the awakening module 210 is specifically configured to: determine, after the VOBC is powered on and when an awakening instruction is received, that the train awakening process is started; read, from a non-volatile storage area, positioning information of a train stored before power-off; initialize, a train position according to the positioning information of the train stored before power-off; perform, a cab activation process according to the initialized position of the train; after the cab is successfully activated, initialize, a running direction to be downward, and enter an automatic running mode; in the automatic running mode, interact, with a zone controller ZC to perform a ZC registration process; acquire, movement authorization of the ZC after the registration process is completed; and complete, the awakening process after performing a static test and a dynamic test.

Optionally, the awakening module 210 is further configured to: after the VOBC is powered on, perform a self-check process by the VOBC; and when the self-check process is successfully completed and an awakening instruction is received, determine that the VOBC is in an awakening start state, and notify a power-on awakening module that the self-check of the VOBC is successful.

In another possible implementation, the awakening module 210 is specifically configured to: output an equivalent key signal to a device in a cab if the VOBC determines that initialized train position is within a preset parking area of the parking garage, the equivalent key signal being used to activate the cab; and enter, a standby mode, and/or send prompt information for fault positioning to the ATS system if the VOBC determines that initialized train position is not within the preset parking area of the parking garage, the standby mode being used to wait for manual troubleshooting.

Optionally, the awakening module 210 is further configured to: after the VOBC reads the positioning information of the train stored before power-off, perform, cyclic redundancy check (CRC) according to the positioning information of the train stored before power-off. If the CRC succeeds, the VOBC establishes a communication connection with the ATS system, and performs the step of initializing, by the VOBC, a train position according to the positioning information of the train stored before power-off. If the CRC fails, the VOBC enters a manual driving mode.

The acquiring module 220 is configured to acquire a running plan sent by an automatic train supervision (ATS) system after the train is successfully awakened.

The setting module 230 is configured to set, according to a direction indicated by the running plan, a running direction of the train to be downward or upward.

The control module 240 is configured to: when the running direction is set to be downward, use, as a head of the train for train positioning, the other end of the train not configured with the VOBC, to acquire positioning information of the train; when the running direction is set to be upward, use, as the head of the train for train positioning, one end of the train configured with the VOBC, to acquire the positioning information of the train; and control, according to the positioning information of the train, the train to pull out of a parking garage.

In a possible implementation, the control module 240 is specifically configured to: during downward pulling of the parking garage, control, when determining that the train needs to travel in a direction of the other end not configured with the VOBC, the train to move forward in the downward direction; and during downward pulling of the parking garage, control, when determining that the train needs to travel in a direction of the one end configured with the VOBC, the train to move backward in the downward direction.

Optionally, the control module 240 is further configured to: during upward pulling of the parking garage, control, when determining that the train needs to travel in a direction of the other end not configured with the VOBC, the train to move backward in the upward direction; and during upward pulling of the parking garage, control, when determining that the train needs to travel in a direction of the one end configured with the VOBC, the train to move forward in the upward direction.

Optionally, the control module 240 is further configured to: acquire a distance between the one end of the train configured with the VOBC and a ground transponder; subtract a length of the train from the distance between the end of the train configured with the VOBC and the ground transponder, to obtain a distance between the other end of the train not configured with the VOBC and the ground transponder; and determine a position of the head of the train according to the distance between the other end of the train not configured with the VOBC and the ground transponder.

It should be noted that the foregoing description of the train control method embodiment is also applicable to the train control apparatus 200 of the embodiment, which is implemented in a similar principle, and details are not described herein again.

According to the train control apparatus in one embodiment, the VOBC is configured at only one end of the train, thereby simplifying the train configuration and reducing train costs. In addition, it only awakens the VOBC at one end of the train, which shortens duration required for awakening the train and improves the efficiency of awakening the train. Moreover, in one embodiment, when the running direction is set to be downward, the VOBC uses, as the head for train positioning, the other end of the train not configured with the VOBC, to acquire the positioning information of the train. When the running direction is set to be upward, the VOBC uses, as the head for train positioning, one end of the train configured with the VOBC, to acquire the positioning information of the train. The train is controlled, according to the positioning information of the train, to pull out of the parking garage. Therefore, in different running directions, the end of the train does not need to be changed to activate a cab, simplifying the operation steps and improving the running efficiency of the train.

In order to implement the foregoing embodiment, the present disclosure further proposes a computer device, including: a memory, a processor, and a computer program stored on the memory and executable on the processor, when the processor executes the program, the train control method according to the foregoing embodiment of the present disclosure being implemented.

In the descriptions of this specification, descriptions using reference terms "an embodiment", "some embodiments", "an example", "a specific example", or "some examples" mean that specific characteristics, structures, materials, or features described with reference to the embodiment or example are included in at least one embodiment or example of the present disclosure. In this specification, schematic descriptions of the foregoing terms do not necessarily directed at a same embodiment or example. In addition, the described specific features, structures, materials, or features can be combined in a proper manner in any one or more embodiments or examples. In addition, in a case that is not mutually contradictory, a person skilled in the art can combine or group different embodiments or examples that are described in this specification and features of the different embodiments or examples.

In addition, the terms "first" and "second" are merely intended for a purpose of description, and shall not be understood as an indication or implication of relative importance or implicit indication of a quantity of indicated technical features. Therefore, features defining "first" and "second" can explicitly or implicitly include at least one of the features. In the descriptions of the present disclosure, unless explicitly specified, "multiple" means at least two, for example, two or three.

Any process or method in the flowcharts or described herein in another manner may be understood as indicating a module, a segment, or a part including code of one or more executable instructions for implementing a particular logical function or process step. In addition, the scope of preferred embodiments of the present disclosure include other implementations which do not follow the order shown or discussed, including performing, according to involved functions, the functions basically simultaneously or in a reverse order, which should be understood by technical personnel in the technical field to which the embodiments of the present disclosure belong.

The logic and/or steps shown in the flowcharts or described in any other manner herein, for example, a sequenced list that may be considered as executable instructions used for implementing logical functions, may be specifically implemented in any computer readable medium to be used by an instruction execution system, apparatus, or device (for example, a computer-based system, a system including a processor, or another system that can obtain an instruction from the instruction execution system, apparatus, or device and execute the instruction) or to be used by combining such instruction execution systems, apparatuses, or devices. In the context of this specification, a "computer-readable medium" may be any apparatus that can include, store, communicate, propagate, or transmit the program for use by the instruction execution system, apparatus, or device or in combination with the instruction execution system, apparatus, or device. More specific examples (a non-exhaustive list) of the computer readable medium include the following: an electronic connection portion (an electronic apparatus) having one or more cable layouts, a portable computer diskette (a magnetic apparatus), a random access memory, a read-only memory, an erasable programmable read-only memory (EPROM or a flash), a fiber apparatus, and a portable compact disc read-only memory (CDROM). In addition, the computer readable medium may even be a piece of paper for printing the program, or another proper medium, because, for example, optical scanning may be performed on the paper or another medium, and then processing is performed by performing editing and decryption, or in another proper manner to obtain the program in an electronic manner. Then the program is stored in a computer memory.

It should be understood that parts of the present disclosure may be implemented by using hardware, software, firmware, or combinations thereof. In the foregoing implementations, a plurality of steps or methods may be implemented by using software or firmware that are stored in a memory and are executed by a proper instruction execution system. For example, if hardware is used for implementation, same as in another implementation, implementation may be performed by any one of the following technologies well known in the art or a combination thereof: a discrete logic circuit including a logic gate circuit for implementing a logic function of a data signal, a dedicated integrated circuit including a proper combined logic gate circuit, a programmable gate array (PGA), a field programmable gate array (FPGA), and the like.

A person of ordinary skill in the art may understand that all or some of the steps of the method embodiments may be implemented by a program instructing relevant hardware. The program may be stored in a computer-readable storage medium. When the program is run, one or a combination of the steps of the method embodiments are performed.

In addition, the functional modules in the embodiments of the present disclosure may be integrated into one processing module, or each of the units may exist alone physically, or two or more units may be integrated into one module. The integrated module may be implemented in a hardware form, or may be implemented in a form of a software functional module. If implemented in the form of software functional modules and sold or used as an independent product, the integrated module may also be stored in a computer-readable storage medium.

The aforementioned storage medium may be a read-only memory, a magnetic disk, or an optical disc. Although the embodiments of the present disclosure are shown and described above, it can be understood that, the foregoing embodiments are exemplary, and cannot be construed as a limitation to the present disclosure. Within the scope of the present disclosure, a person of ordinary skill in the art may make changes, modifications, replacement, and variations to the foregoing embodiments.

What is claimed is:

1. A train control method for a train, wherein one end of the train is configured with a vehicle on-board controller (VOBC) and the other end of the train is not configured with a VOBC, the method comprising:

performing, by the VOBC, a train awakening process;

acquiring, by the VOBC, a running plan sent by an automatic train supervision (ATS) system after a train is successfully awakened;

setting, by the VOBC according to a direction indicated by the running plan, a running direction of the train to be downward or upward;

when the running direction is set to be downward, using, by the VOBC, as a head for train positioning, the other end of the train not configured with the VOBC, to acquire positioning information of the train;

when the running direction is set to be upward, using, by the VOBC, as the head for train positioning, the one end of the train configured with the VOBC, to acquire positioning information of the train; and controlling, according to the positioning information of the train, the train to pull out of a parking garage.

2. The train control method according to claim 1, wherein the controlling, according to the positioning information of the train, the train to pull out of a parking garage comprises:

during downward pulling out of the parking garage, controlling, by the VOBC when determining that the train needs to travel toward the other end not configured with the VOBC, the train to move forward in the downward direction; and during downward pulling out of the parking garage, controlling, by the VOBC when determining that the train needs to travel toward the one end configured with the VOBC, the train to move backward in the downward direction.

3. The train control method according to claim 1, wherein the controlling, according to the positioning information of the train, the train to pull out of a parking garage comprises:

during upward pulling out of the parking garage, controlling, by the VOBC when determining that the train needs to travel toward the other end not configured with the VOBC, the train to move backward in the upward direction; and during upward pulling out of the parking garage, controlling, by the VOBC when determining that the train needs to travel toward the one end configured with the VOBC, the train to move forward in the upward direction.

4. The train control method according to claim 1, wherein the performing, by the VOBC, a train awakening process comprises:

reading, when the VOBC is powered on and an awakening instruction is received, by the VOBC from a non-volatile storage area, positioning information of the train stored before power-off;

initializing, by the VOBC, a train position according to the positioning information of the train stored before power-off;

performing, by the VOBC, a cab activation process according to the initialized train position;

after the cab is successfully activated, initializing, by the VOBC, the running direction to be downward, and entering an automatic running mode;

in the automatic running mode, interacting, by the VOBC, with a zone controller (ZC) to perform a ZC registration process;

acquiring, by the VOBC, movement authorization of the ZC after the registration process is completed; and completing, by the VOBC, the awakening process after performing a static test and a dynamic test.

5. The train control method according to claim 4, wherein after the VOBC is powered on, the method further comprises:

performing, by the VOBC, a self-check process; and when the self-check process is successfully completed and the awakening instruction is received, determining that the VOBC is in an awakening start state, and notifying a power-on awakening module that the self-check of the VOBC is successful.

6. The train control method according to claim 4, wherein the performing, by the VOBC, a cab activation process according to the initialized train position comprises:

outputting an equivalent key signal to a device in a cab if the VOBC determines that the initialized train position is within a preset parking area of the parking garage, the equivalent key signal is used to activate the cab; and entering, by the VOBC, a standby mode, and/or sending prompt information for fault positioning to the ATS system if the VOBC determines that the initialized train position is not within a preset parking area of the parking garage, the standby mode being used to wait for manual troubleshooting.

7. The train control method according to claim 4, wherein after the reading, by the VOBC from a non-volatile storage area, positioning information of the train stored before power-off, the method further comprises:

performing, by the VOBC, cyclic redundancy check (CRC) according to the positioning information of the train stored before power-off;

if the CRC succeeds, establishing, by the VOBC, a communication connection with the ATS system, and initializing, by the VOBC, a train position according to the positioning information of the train stored before power-off; and if the CRC fails, entering, by the VOBC, a manual driving mode.

8. The train control method according to claim 1, wherein the using, by the VOBC, as a head for train positioning, the other end of the train not configured with the VOBC, to acquire positioning information of the train comprises:

acquiring a distance between the one end of the train configured with the VOBC and a ground transponder;

subtracting a length of the train from the distance between the end of the train configured with the VOBC and the ground transponder, to obtain a distance between the other end of the train not configured with the VOBC and the ground transponder; and determining a position of the head of the train according to the distance between the other end of the train not configured with the VOBC and the ground transponder.

9. A train control system, comprising:

a vehicle on-board controller (VOBC) and an automatic train supervision (ATS) system communicating with each other, wherein one end of a train is configured with the VOBC and the other end of the train is not configured with a VOBC, the VOBC being configured to perform:

performing, by the VOBC, a train awakening process;

acquiring, by the VOBC, a running plan sent by an automatic train supervision (ATS) system after a train is successfully awakened;

setting, by the VOBC according to a direction indicated by the running plan, a running direction of the train to be downward or upward;

when the running direction is set to be downward, using, by the VOBC, as a head for train positioning, the other end of the train not configured with the VOBC, to acquire positioning information of the train;

when the running direction is set to be upward, using, by the VOBC, as the head for train positioning, the one end of the train configured with the VOBC, to acquire positioning information of the train; and controlling, according to the positioning information of the train, the train to pull out of a parking garage, and the ATS system being configured to send a running plan to the VOBC after the VOBC is successfully awakened.

10. The train control system according to claim 9, further comprising:

a vehicle on-board power-on awakening module communicating with the ATS system;

the ATS system being further configured to: acquire a power-on awakening command for power-on awakening of each system of the train, each system of the train comprising the VOBC;

send the power-on awakening command to the vehicle on-board power-on awakening module;

receive the power-on awakening command returned by the vehicle on-board power-on awakening module, and display, on an interface, the power-on awakening command returned by the vehicle on-board power-on awakening module; and send the power-on awakening command to the vehicle on-board power-on awakening module again when a user confirmation instruction is detected; and the vehicle on-board power-on awakening module being configured to: return the power-on awakening command to the ATS system after receiving the power-on awakening command sent by the ATS system; again receive the power-on awakening command sent by the ATS system; and supply, when it is determined that the two received power-on awakening commands are the same, power to a train indicated by the power-on awakening command.

11. The train control system according to claim 10, further comprising:

an awakening relay;

the vehicle on-board power-on awakening module being specifically configured to: after it is determined that the two received power-on awakening commands are the same, control the awakening relay to continue supplying power to the train, and send, to the ATS system, a status indication message for indicating that power-on awakening is being performed, so that the ATS system displays the status indication message; and the awakening relay being configured to close a contact under the control of the vehicle on-board power-on awakening module, to continue supplying power to the train.

12. The train control system according to claim 10, further comprising: a feedback relay;

the feedback relay being configured to close a contact after the VOBC of the train is powered on;

the vehicle on-board power-on awakening module further communicates with the VOBC, and is further configured to send an awakening instruction to the VOBC when it is detected that the feedback relay closes the contact, the awakening instruction being used to control the VOBC to perform an awakening process.

13. The train control system according to claim 12, wherein the vehicle on-board power-on awakening module is further configured to:

send, to the ATS system, a status indication message for indicating that power-on awakening is being performed after it is detected that the feedback relay closes the contact; and send, to the ATS system, a status indication message for indicating a power-on awakening failure if it is not detected, within preset duration, that the feedback relay closes the contact.

14. A train control apparatus, applied to a vehicle on-board controller (VOBC), comprising:

an awakening module configured to perform a train awakening process;

an acquiring module configured to acquire a running plan sent by an automatic train supervision (ATS) system after a train is successfully awakened, wherein one end of a train is configured with the VOBC and the other end of the train is not configured with a VOBC;

a setting module configured to set, according to a direction indicated by the running plan, a running direction of the train to be downward or upward; and a control module configured to: when the running direction is set to be downward, use, as a head of the train for train positioning, the other end of the train not configured with the VOBC, to acquire positioning information of the train; when the running direction is set to be upward, use, as the head of the train for train positioning, the one end of the train configured with the VOBC, to acquire the positioning information of the train; and control, according to the positioning information of the train, the train to pull out of a parking garage.

* * * * *